US009814341B2

(12) United States Patent
Kobyluck

(10) Patent No.: US 9,814,341 B2
(45) Date of Patent: Nov. 14, 2017

(54) DEVICE AND METHOD OF REMOVING A SPORTS BRA

(71) Applicant: Lori Ann Kobyluck, Waterford, CT (US)

(72) Inventor: Lori Ann Kobyluck, Waterford, CT (US)

( * ) Notice: Subject to any disclaimer, the term of this patent is extended or adjusted under 35 U.S.C. 154(b) by 1 day.

(21) Appl. No.: 15/003,855

(22) Filed: Jan. 22, 2016

(65) Prior Publication Data

US 2016/0213184 A1 Jul. 28, 2016

Related U.S. Application Data

(60) Provisional application No. 62/106,854, filed on Jan. 23, 2015.

(51) Int. Cl.
*A47G 25/90* (2006.01)
*A41C 3/00* (2006.01)

(52) U.S. Cl.
CPC ..... *A47G 25/90* (2013.01); *A41C 3/00* (2013.01); *A41C 3/0057* (2013.01); *A41C 3/005* (2013.01); *A41D 2400/44* (2013.01); *A41D 2400/70* (2013.01)

(58) Field of Classification Search
CPC .... A47G 25/90; A47G 25/908; A41C 3/0057; A41C 3/005; A41C 3/0028; A41C 3/0064; A41C 3/00; A41D 2400/44; A41D 2400/70
See application file for complete search history.

(56) References Cited

U.S. PATENT DOCUMENTS

| | | | | |
|---|---|---|---|---|
| 1,810,363 | A * | 6/1931 | Malapeta | A47G 25/90 223/111 |
| 2,525,666 | A * | 10/1950 | Glynn | A41C 1/06 450/14 |
| D238,630 | S * | 2/1976 | Ammons | D11/221 |
| 4,202,343 | A | 5/1980 | Ichelson | |
| 4,879,766 | A | 11/1989 | Hull et al. | |
| D523,238 | S * | 6/2006 | Miyamoto | D3/218 |
| 8,172,639 | B2 | 5/2012 | Swendseid et al. | |
| 8,460,054 | B2 | 6/2013 | Swendseid et al. | |
| 8,533,918 | B1 * | 9/2013 | Ketter | A44B 19/285 2/218 |
| 2014/0131410 | A1 * | 5/2014 | Looper | F41C 33/048 224/587 |

FOREIGN PATENT DOCUMENTS

| | | | |
|---|---|---|---|
| HR | WO2016075500 | A1 * | 5/2016 |
| JP | 2002242008 | A * | 8/2002 |

* cited by examiner

*Primary Examiner* — Ismael Izaguirre
(74) *Attorney, Agent, or Firm* — Bachman & LaPointe, P.C.

(57) ABSTRACT

A method of removing a sports bra comprising inserting a sports bra removal device between a band of the sports bra and a torso of a wearer. The sports bra removal device is looped around the band. The method includes cinching the sports bra removal device around the band. The method includes doffing the sports bra from the wearer and removing the device from the sports bra.

8 Claims, 6 Drawing Sheets

DEVICE AND METHOD OF REMOVING A SPORTS BRA

CROSS-REFERENCE TO RELATED APPLICATION

This application claims the benefit of the U.S. Provisional application No. 62/106,854 that was filed Jan. 23, 2015 by Lori Ann Kobyluck, which was entitled "Device and Method of Removing a Sports Bra," and which is incorporated herein by reference.

BACKGROUND

The present disclosure is directed to a device designed for the ease of removal of sports bras.

The first general exercise bra, initially called a "jockbra", was invented in 1977. Sports bras can either encapsulate or compress breasts. Bras that encapsulate breasts have molded cups, while compression-type bras restrict movement by flattening the breasts. The most common sports bra is basically designed like a tank top with the bottom half cut off. Other designs use gel and water pads, silver fibers, and air bags. A compressed bra is designed to push the breasts against the chest to reduce movement and bounce. A common design uses a stretchable, absorbent fabric such as Lycra designed to reduce irritation by drawing perspiration away from the skin.

Sports bras are designed to be very tight and supportive for breast comfort during physical activity. Due to the very tight fit of a sports bra, doffing a sports bra can be very difficult.

What is needed is a device that can facilitate easy removal of a sports bra.

SUMMARY

In accordance with the present disclosure, there is provided a method of removing a sports bra comprising inserting a sports bra removal device between a band of the sports bra and a torso of a wearer. The sports bra removal device is looped around the band. The method includes cinching the sports bra removal device around the band. The method includes doffing the sports bra from the wearer and removing the device from the sports bra.

In another exemplary embodiment, the sports bra removal device comprises a body having a first end and a second end opposite the first end. A ring is coupled to the body adjacent the first end. A handle is formed at the second end, wherein the handle is insertable through the ring.

In another exemplary embodiment, the inserting step further comprises inserting a first device at an end between a first side of the wearer and the band proximate a first arm hole of the sports bra.

In another exemplary embodiment, the method further comprises inserting a second device at an end between a second side of the wearer and the band proximate a second arm hole of the sports bra. The method includes looping the second sports bra removal device around the band. The method includes cinching the second sports bra removal device about the band.

In another exemplary embodiment, the step of looping the device further comprises inserting the handle of the device through the ring of the device.

In another and alternative embodiment, the step of cinching further comprises moving the ring along the body away from the handle. The method includes tightening a loop formation of the device about the band.

In another and alternative embodiment, the step of doffing the sports bra from the wearer further comprises grasping the first device with a first hand on an opposite side of the torso. The method includes grasping the second device with a second hand on an opposite side of the torso. The method includes raising and extending both arms overhead, wherein the sports bra is pulled off the torso and slides out over shoulders and past the elbows up to the wrists and the first and second hands of each arm.

In another exemplary embodiment the removing step further comprises manipulating the first device and second device, un-cinching the loop formation of each of the first and second device. The method includes sliding the ring of each device along each body toward each second end and past each handle.

Further in accordance with the present disclosure, there is provided a sports bra removal device comprising a body portion having a first end and a second end opposite the first end. A ring is coupled to the body at the first end. A handle is formed from the body at the second end opposite the ring. The handle is insertable through the ring.

Other details of the sports bra remover and method of use are set forth in the following detailed description and the accompanying drawing wherein like reference numerals depict like elements.

DETAILED DESCRIPTION

Figure 1:
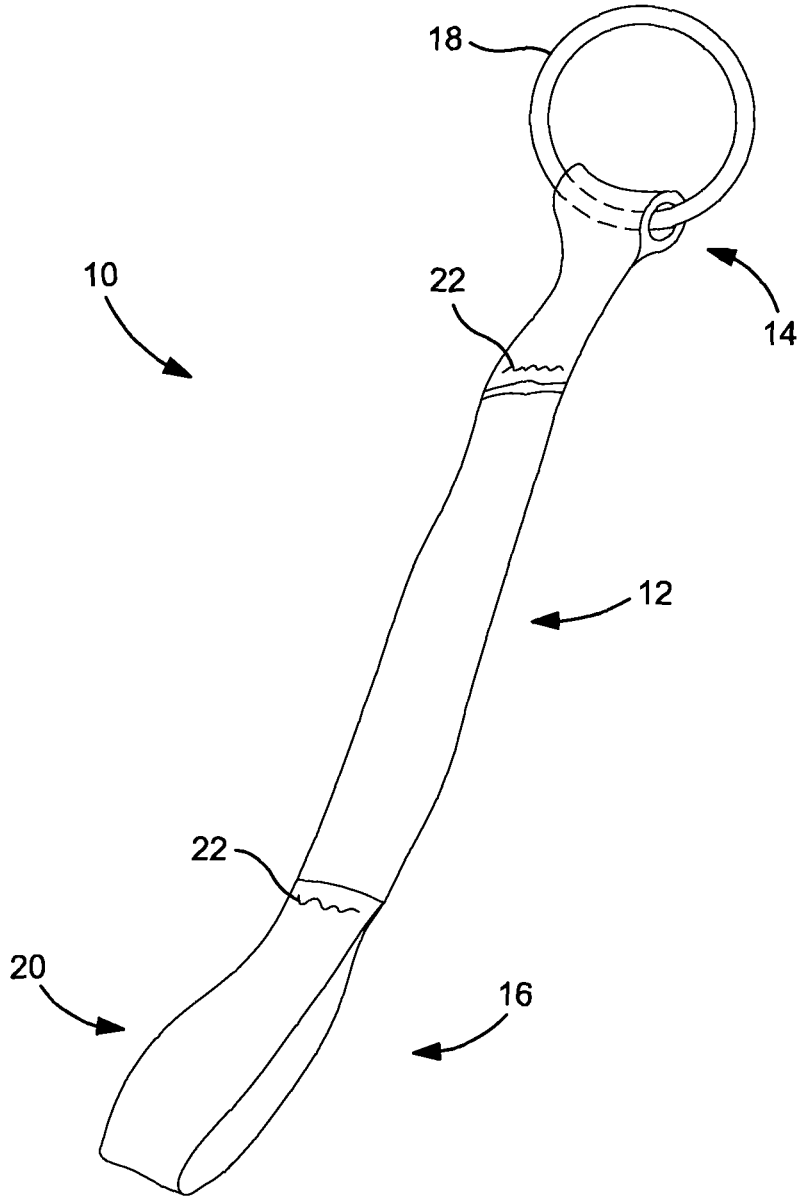
FIG. 1 is an illustration of an exemplary sports bra removal device.

Referring now to FIG. 1, there is illustrated a sports bra removal device, or simply device 10. The removal device 10 comprises a body portion 12 having a first end 14 and a second end 16 opposite the first end 14. The body 12 can be formed from any suitable material that provides both flexibility, good tensile strength, and a relatively soft texture. In an exemplary embodiment the body 12 material can be a strip of webbing made from nylon, polyester, polypropylene, LYCRA, silk, cotton, and the like. The body 12 is configured to bend, flex and loop without undue force. In alternative embodiments, rope, cordage, ribbon or flexible strap can be utilized. In a preferred embodiment, the body 12 can be formed from a length of webbing about 24 inches long and ¾ inch wide. It is contemplated that other dimensions can be utilized.

The removal device 10 includes a ring 18 coupled to the body 12 at the first end 14. The ring 18 can be attached by a variety of means. The ring 18 can comprise an O-shape design or a D-shape, a triangle and the like. The body 12 can be looped through and over the ring 18 and secured by stitching or welding or riveting and the like. In an exemplary embodiment, the ring comprises a polished metal material formed into a ring shape. Brass, chrome plated steel, other metal alloys, plastic, wood, leather and other similarly durable materials can be employed. The ring 18 also possesses very good material strength to resist bending or deformation, and especially fracture. The ring 18 can have a smooth finish. In alternative embodiments the ring 18 can include surface features that improve gripping the ring, such as knurling, pebble, nubs and the like. An overmolding feature can also be incorporated into the ring to provide good tactile properties.

The removal device 10 includes a handle 20 formed from the body 12 at the second end 16 opposite the ring 18. The handle 20 can be formed, in an exemplary embodiment, from the body 12 being looped over, i.e., folded over onto itself and attaching the second end 16 portion of the body 12 proximate the end 16 to the body 12. The body 12 material can be stitched to maintain the handle 20. In alternative embodiments, the loop can be held fast by rivets, welding, stitching, and the like and any combination thereof. The attachment means, (stitching, welding, rivet) of the ring 18 and formation of the handle 20 is shown generally by numeral 22.

In an alternative embodiment, the body 12 can be formed by braiding or weaving multiple lanyards or core fibers such that the ring and handle are formed integrally to the body by weaving a loop at opposite ends of the body, or weaving the ring 18 into the braided body structure 12.

Figure 2:
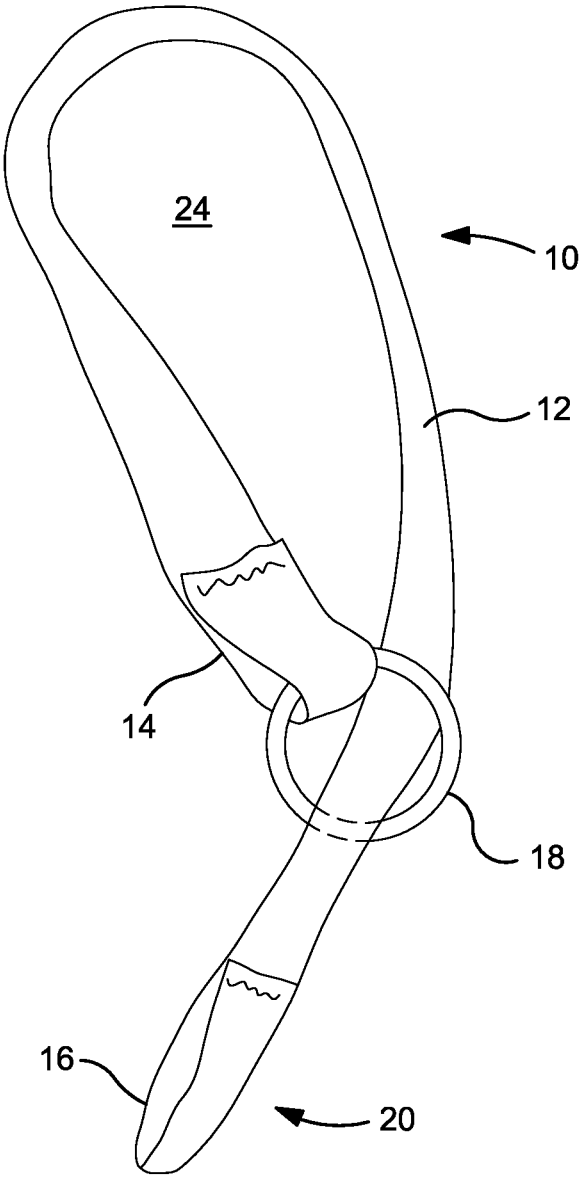
FIG. 2 is an illustration of an exemplary sports bra removal device.

Referring to FIG. 2, the removal device is shown in a looped configuration. The second end 16 is passed through the ring 18 to form a loop formation 24. The ring 18 slides along the body portion 12 thereby changing the size of the loop formation 24. The loop formation 24 is employed to cinch over a garment, such as a sports bra 26, tank top, camisole, shape wear or the like.

Figure 3:
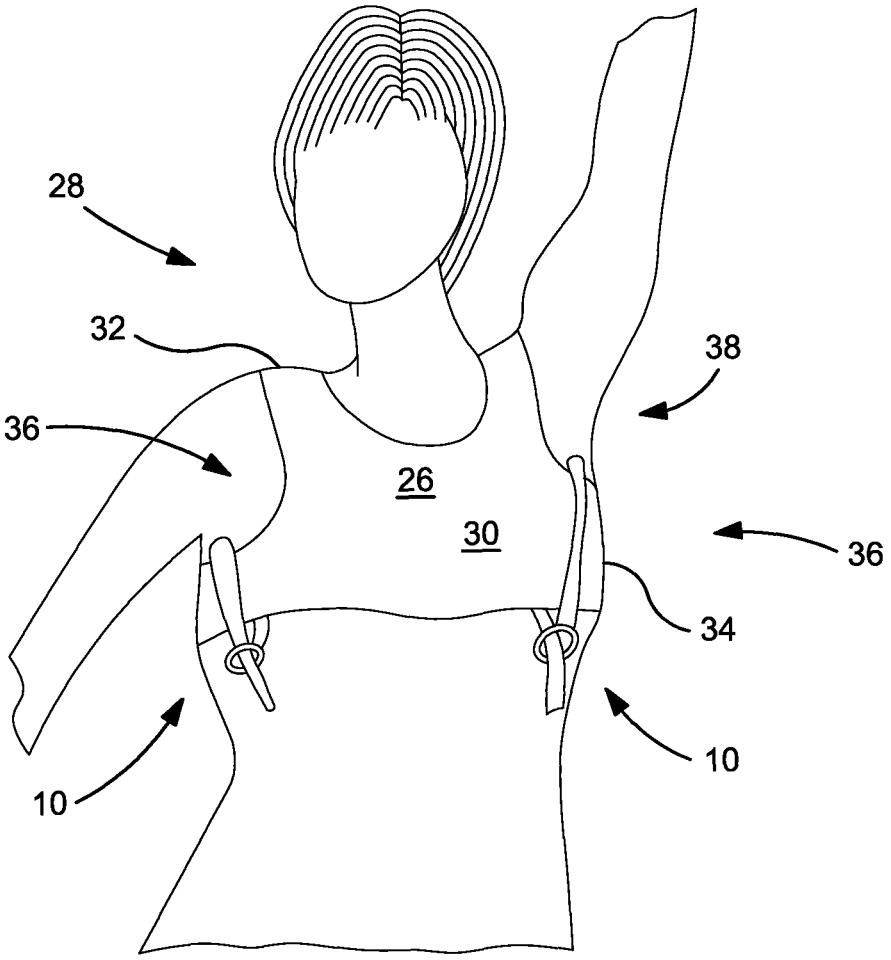
FIG. 3 is an illustration of a pair of exemplary sports bra removal devices looped over a sports bra on a wearer.

Referring to FIG. 3, a pair of exemplary removal devices 10 are illustrated in use with the sports bra 26. The sports bra 26 is shown being worn by a wearer 28. The sports bra 26 fits over the upper torso of the wearer 28 as is common in the art. The sports bra 26 is generally constructed into a pair of support cups 30, a pair of shoulder straps 32, and a band 34 that forms a pair of arm holes 36 between the band and the shoulder straps 36. The band 34 is typically a wide portion of the sports bra that fits completely around the torso 38 of the wearer 28 below the arms. The band 34 is designed to be very snug in order to provide an anchoring support to the other portions of the sports bra 26.

The removal device 10 can be attached to the sports bra 26 proximate the band 34 on either side of the torso 36 of the wearer 28. Either the handle 20 or the ring 18 of the device 10 is inserted or slid between the sports bra 26 proximate the band 34 and the torso 36 portion of the wearer 28. The optimal location to insert the device 10 is through the arm holes 36 and around the band 34 proximate the arm holes 36. The handle 20 is then threaded through the ring 18 to form the loop formation 24 of the device 10. The method is repeated with another device 10 on the opposite side of the wearer 28 and sports bra 26 as shown in FIG. 3.

Figure 4:
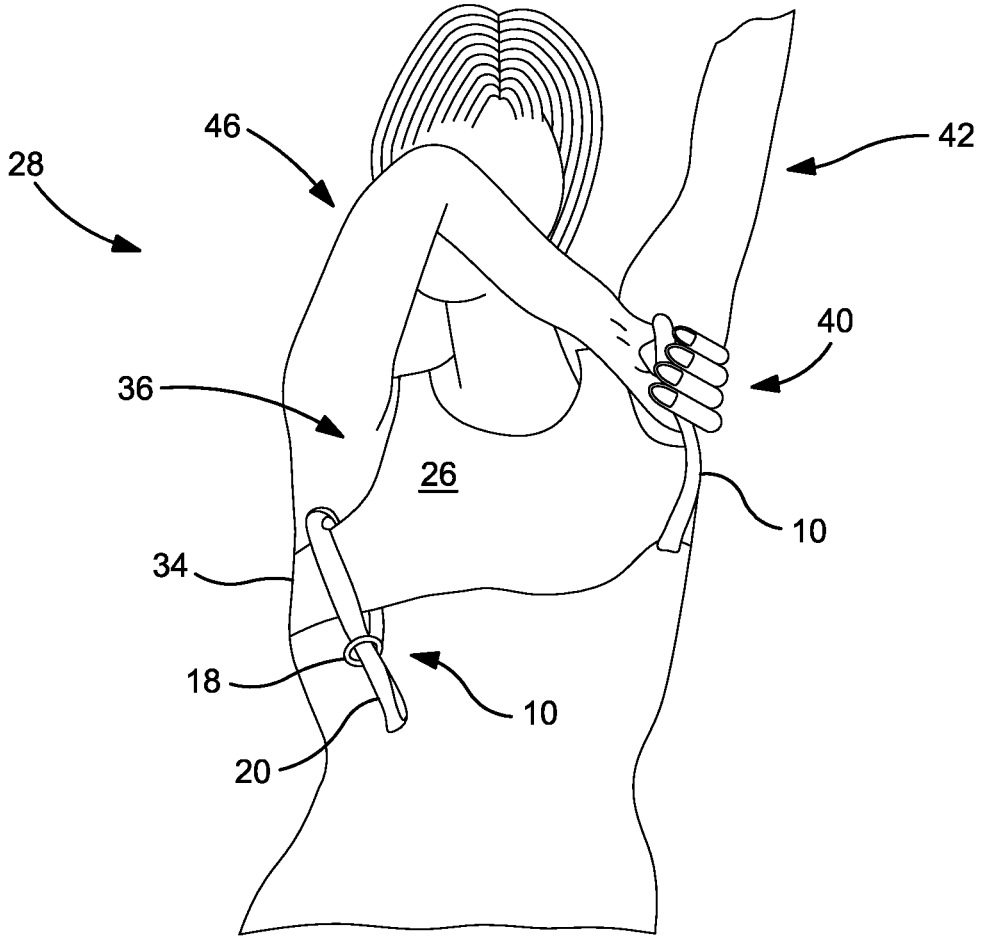
FIG. 4 is an illustration of a pair of exemplary sports bra removal devices looped over a sports bra on a wearer beginning to remove the sports bra.

FIG. 4, illustrates a portion of the process of removing the sports bra 26. Removal of the sports bra 26 by use of a pair of removal devices 10 is done similarly to removing a tee-shirt. The wearer 28 reaches with a right hand 40 to grasp the device 10 attached proximate to the left arm 42. The wearer 28 grasps the handle 20 portion of the device 10. By grasping the handle 20 and extending the right arm 44 upward, overhead, the ring 18 cinches down along the body 12 and tightens over the band 34. For better illustration purposes, only a single hand is shown grasping the device 10. The wearer 28 also reaches over with the left hand 44 to the other device 10 and grasps the handle 20. The wearer 28 also extends the left arm 42 upward and overhead simultaneously with the right arm 46. The sports bra 26 band 34 is lifted up over the torso, breasts and shoulders and past the elbows as a result of the upward lifting motion of the arms 42, 46.

Figure 5:
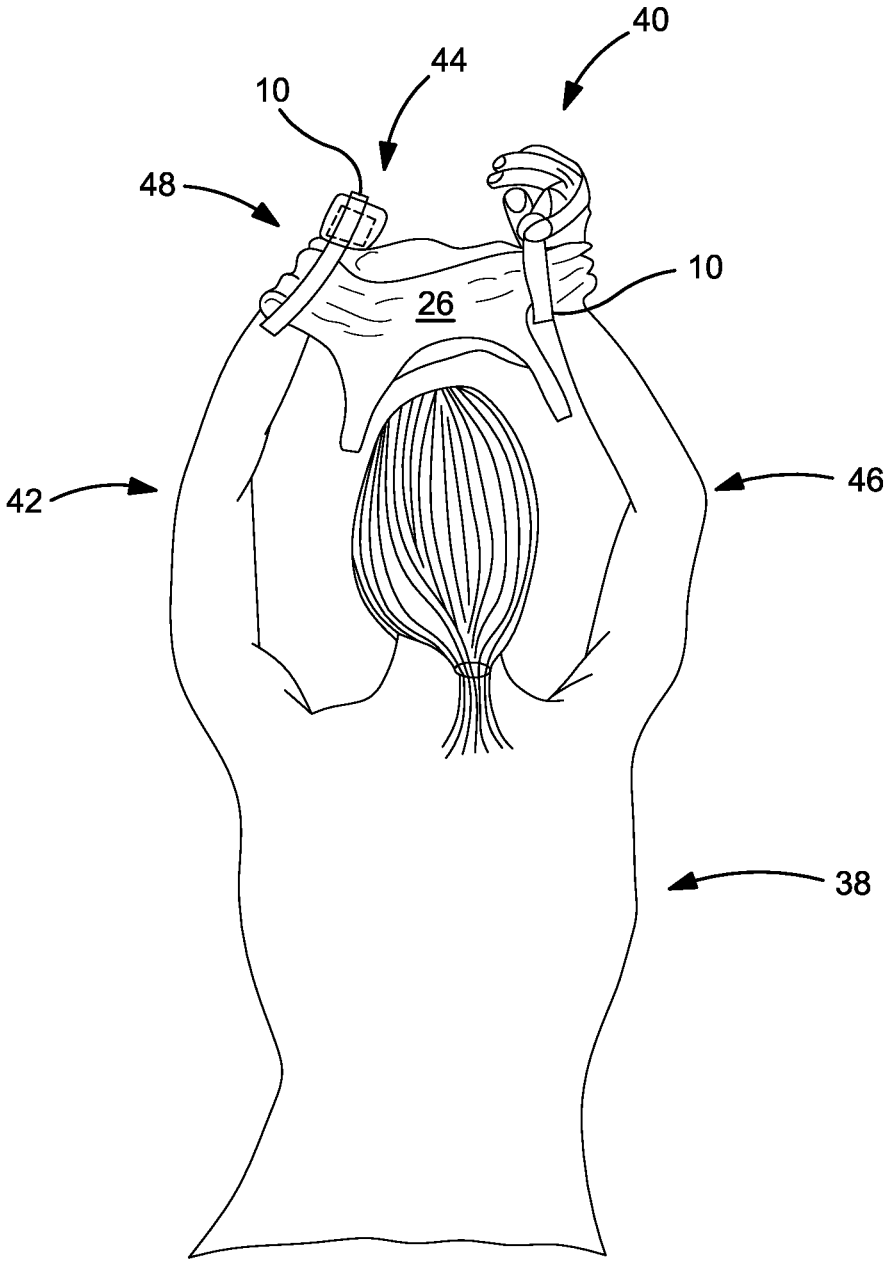
FIG. 5 is an illustration of a pair of exemplary sports bra removal devices looped over a sports bra removed from a wearer.

FIG. 5 shows a rear view of the wearer 28 in the latter stages of removal of the sports bra 26. As shown in FIG. 5, the sports bra 26 has been doffed from the torso 38 and merely remains encircled around the wrists 48 and hands 40, 44. The wearer 28 merely removes the sports bras 26 from the hands 40, 44 and releases the handles 20 of the device 10. The device 10 can be removed from the band 34 of the sports bra 26 by allowing the ring 18 to slide off of the body 12 toward the handle 20 past the second end 16 unlooping the loop formation 24.

In an alternative embodiment, only one device 10 can be utilized to remove one side of the sports bra 26 at a time. With the process repeated for the other side where the sports bra 26 has not yet been doffed.

Figure 6:
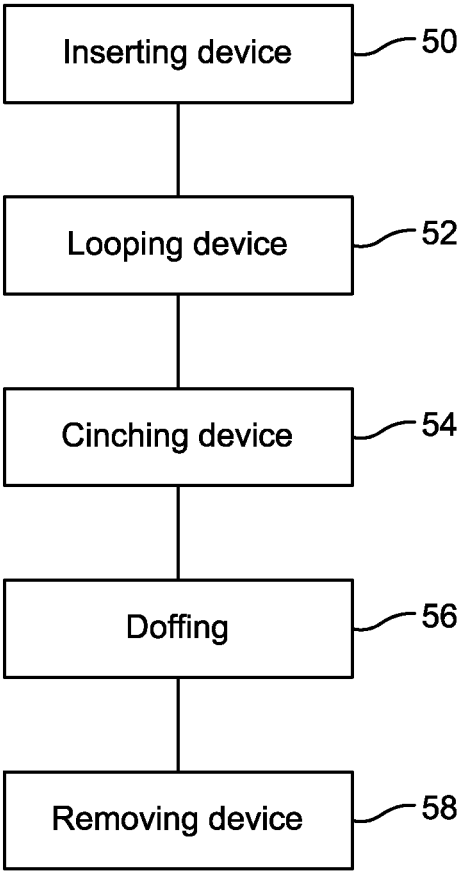
FIG. 6 is a process chart of the inventive method.

Referring to FIG. 6, a process diagram of the method of removal is shown. The first step 50 includes inserting the device 12 at one end 14 or 16 between the wearer's side and the band 34 proximate the arm hole 36. The next step 52 includes looping the device 12 by inserting the second end 16 (handle 20) through the ring 18. After looping 52, the device 12 the next step 54 is cinching the device around the band 34 of the sports bra 26. The ring 18 is moved along the body 12 away from the handle 20 tightening the loop formation 24 about the band 34. The wearer 28 can now perform the next step 56, doffing the sports bra 26. Doffing 56 includes firmly grasping each device 12 with each hand on an opposite side of the torso 38. That is, the right hand 40 grasps the device 12 below the left arm 42. The left hand 44 grasps the other device 12 below the right arm 46. The wearer 28 raises and extends both arms 42, 46 overhead. The sports bra 26 is pulled off the torso and slides out over the shoulders and elbows to the wrists 48 and hands 40, 44. The final step 58 includes removing the devices 12 from the sports bra 26. The devices 12 are manipulated to allow the loop formation 24 to un-cinch, so that the ring 18 slides along the body 12 toward the second end 16 and past the handle 20.

The sports bra removal device 10 is reusable. The device 10 is easily manipulated. The device 10 can be easily manufactured. The device 10 enables the wearer 28 the freedom to remove the sports bra 26 with ease and avoids the hassle of trying to remove the tight fitting garment without the aid of the device 10.

There has been provided a device for the removal of a sports bra and method of removal. While the sports bra removal device has been described in the context of specific embodiments thereof, other unforeseen alternatives, modifications, and variations may become apparent to those skilled in the art having read the foregoing description. Accordingly, it is intended to embrace those alternatives, modifications, and variations which fall within the broad scope of the appended claims.

What is claimed is:

1. A method of removing a sports bra comprising:

inserting a sports bra removal device between a band of said sports bra and a torso of a wearer;

looping the sports bra removal device around the band;

cinching the sports bra removal device around the band;

doffing the sports bra from the wearer; and removing the device from the sports bra.

2. The method according to claim 1, wherein said sports bra removal device comprises a body having a first end and a second end opposite said first end;

a ring is coupled to said body adjacent said first end, a handle is formed at said second end, wherein said handle is insertable through said ring.

3. The method according to claim 2, wherein the step of looping the device further comprises inserting said handle of the device through said ring of the device.

4. The method according to claim 1, wherein the inserting step further comprises inserting a first device at an end between a first side of the wearer and the band proximate a first arm hole of the sports bra.

5. The method according to claim 4, further comprising:

inserting a second device at an end between a second side of the wearer and the band proximate a second arm hole of the sports bra;

looping the second sports bra removal device around the band; and cinching the second sports bra removal device about the band.

6. The method according to claim 5, wherein the step of doffing the sports bra from the wearer further comprises:

grasping said first device with a first hand on an opposite side of the torso;

grasping said second device with a second hand on an opposite side of the torso;

raising and extending both arms overhead, wherein the sports bra is pulled off the torso and slides out over shoulders and elbows to wrists and said first and second hands of each said arm.

7. The method according to claim 6, wherein the removing step further comprises:

manipulating the first device and second device uncinching the loop formation of each of the first and second device;

sliding the ring of each said device along each said body toward each said second end and past each said handle.

8. The method according to claim 1, wherein the step of cinching further comprises moving said ring along the body away from the handle, tightening a loop formation of the device about the band.

* * * * *